United States Patent [19]

Holcomb et al.

[11] Patent Number: 4,996,787

[45] Date of Patent: Mar. 5, 1991

[54] SIGSAUER PISTOL WITH CONCEALED RADIO TRANSMITTER

[75] Inventors: Jack N. Holcomb, 1400 NW. 62nd St., Fort Lauderdale, Fla. 33307; Konrad K. Pangratz, Fort Lauderdale, Fla.

[73] Assignee: Jack N. Holcomb, Fort Lauderdale, Fla.

[21] Appl. No.: 529,380

[22] Filed: May 29, 1990

[51] Int. Cl.[5] ..... F41C 27/00

[52] U.S. Cl. ..... 42/7; 42/50; 42/71.02; 42/106

[58] Field of Search ..... 42/6, 7, 50, 71.02, 42/106, 71.01; 340/539, 567, 693; 379/428, 434, 440; 455/66, 89, 90

[56] References Cited

U.S. PATENT DOCUMENTS

| | | | |
|---|---|---|---|
| 2,990,471 | 6/1961 | Tiffany | 42/71.01 |
| 4,008,478 | 2/1977 | Ikrath et al. | 42/106 |
| 4,936,037 | 6/1990 | Holcomb et al. | 42/106 |

*Primary Examiner*—Charles T. Jordan
*Assistant Examiner*—Richard W. Wendtland
*Attorney, Agent, or Firm*—Oltman and Flynn

[57] ABSTRACT

A SigSauer pistol is modified to hold on the inside of its plastic handle grip an antenna assembly and spring contacts connected conductively to the antenna assembly. A modified magazine casing in the handle of the pistol has a chamber below a false bottom for receiving batteries and a printed circuit board carrying a radio transmitter and microphone. Electrical contacts on the outside of the magazine casing engage the spring contacts on the inside of the handle grip when the magazine casing is slidably inserted into the usual metal handle body on the pistol. Corresponding contacts on the inside of the magazine casing engage contacts on the printed circuit board that are connected electrically to the transmitter. Downwardly-facing battery switch contacts in the chamber are connected electrically to the transmitter and are positioned to engage respective terminals of two series-connected batteries.

10 Claims, 4 Drawing Sheets

SIGSAUER PISTOL WITH CONCEALED RADIO TRANSMITTER

This invention relates to a SigSauer high power pistol with a concealed radio transmitter for use by a law enforcement agent or a witness cooperating with the government to make a sound recording of a conversation that might incriminate a criminal suspect.

BACKGROUND OF THE INVENTION

Criminals generally, and particularly those trafficking illegally in controlled substances, are vigilant and suspicious of anything that might be used to record an incriminating conversation. To some extent, a SigSauer automatic pistol is not likely to arouse suspicion because a hand gun is a common tool of their own trade. Nonetheless, every precaution should be taken to insure that the criminal suspect is not alerted to the fact that the gun has a radio transmitter capable of broadcasting what he or she is saying to a sound recording device located elsewhere.

U.S. patent application Ser. No. 07/375,958, filed July 7, 1989 and assigned to the same assignee as the present invention, discloses a Browning automatic pistol modified to contain a hidden radio transmitter for broadcasting conversations taking place in the vicinity of the pistol while maintaining its ability to discharge bullets in the usual way.

SUMMARY OF THE INVENTION

The present invention achieves the same objectives in a SigSauer pistol of known design.

A principal object of this invention is to provide a SigSauer pistol modified in a novel manner to hold a microphone for picking up voice conversations in its vicinity, a radio transmitter including an antenna for broadcasting those conversations, and batteries for powering the transmitter.

Preferably, in accordance with this invention the usual plastic grip on the handle of the SigSauer pistol is recessed to hold an antenna assembly and spring contacts providing electrical connections to the antenna. A magazine casing, identical in appearance to the usual magazine for this gun, is modified to contain a false bottom about half-way down, and below this false bottom are positioned a radio transmitter, batteries for powering the transmitter, contacts which connect the terminals of the batteries to the transmitter, and contacts on the outside of the magazine casing connected electrically to the transmitter and engageable with the spring contacts for the antenna when the magazine casing is slidably inserted into the gun handle.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
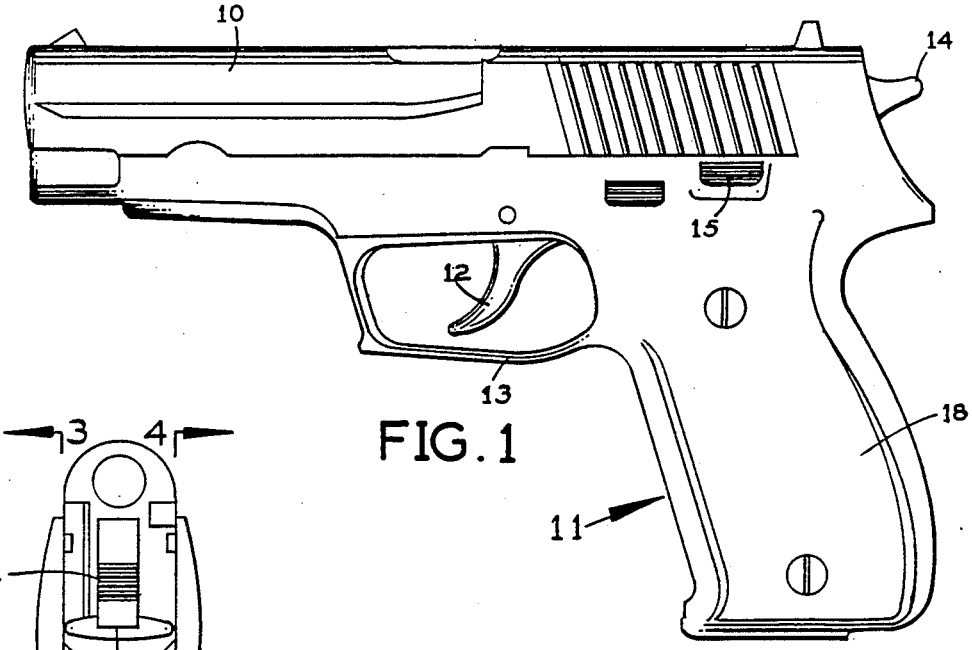
FIG. 1 is a side elevation of a SigSauer pistol modified internally to include a battery-powered radio transmitter in accordance with the present invention.

Referring first to FIG. 1, the gun shown there is a SigSauer P226 9 mm. high power, automatic pistol having a gun barrel 10, a handle 11 extending down from the barrel at its rear end, a trigger 12, a trigger guard 13, a hammer 14 and a safety 15.

Figure 2:
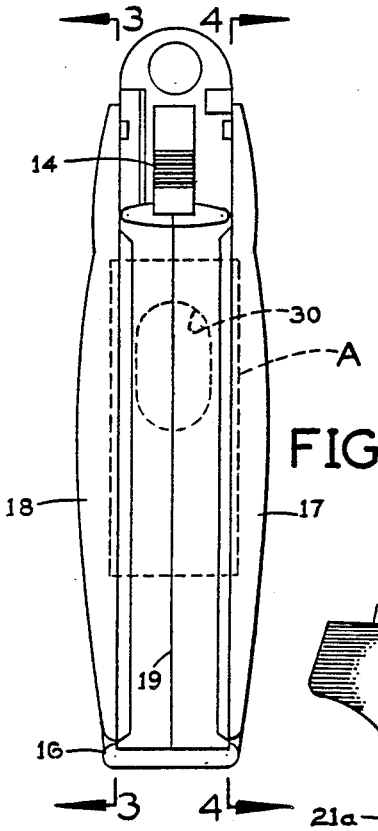
FIG. 2 is a rear elevation of this pistol.
Figure 11:
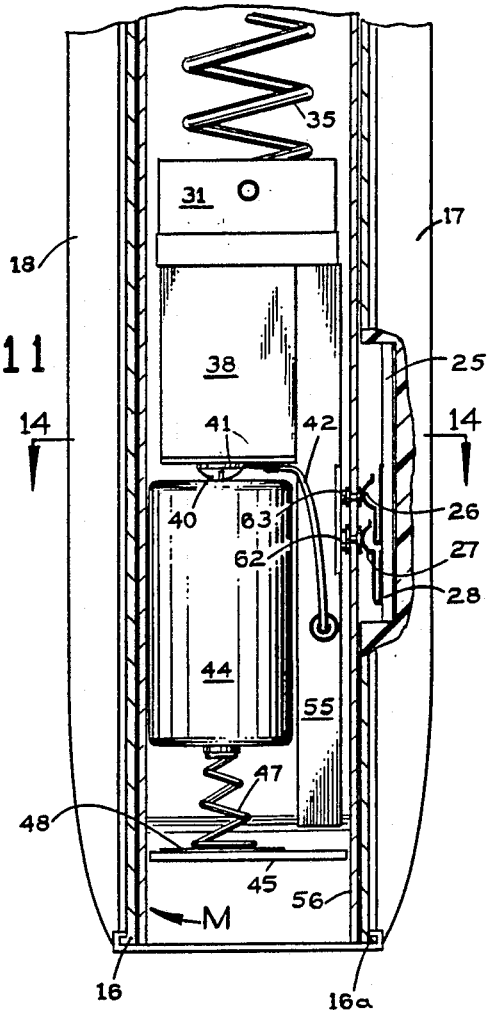
FIG. 11 is a section taken along the line 11—11 in FIG. 10.
Figure 13:
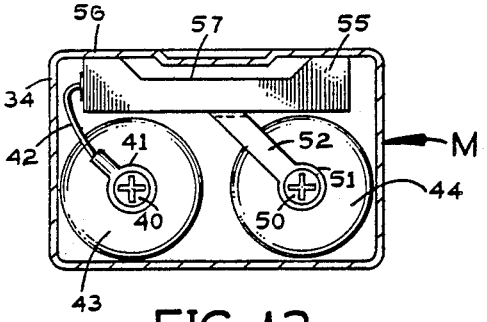
FIG. 13 is a cross-section taken along the line 13—13 in FIG. 10.
Figure 12:
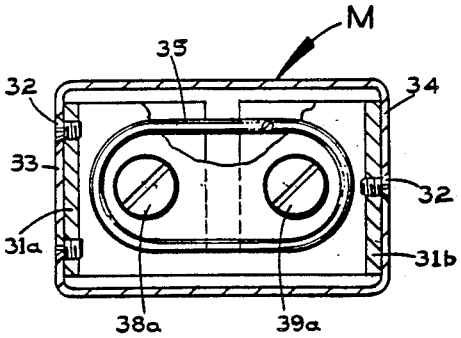
FIG. 12 is a cross-section taken along the line 12—12 in FIG. 8.

The handle 11 has a metal inner body, the lower part of which appears at 16 in FIGS. 2 and 11. This inner body of the handle is of hollow generally rectangular cross-section and it slidably receives a magazine casing M (FIGS. 8–13). The metal inner body 16 of the handle has openings 116 and 116' (FIG. 14) in its opposite sides which are relatively large both upwardly and from front to back on the handle. The magazine casing M is slidably insertable and removable through a complementary opening **16*a* (FIG. 11) in the lower end of the inner handle body 16**.

Figure 6:
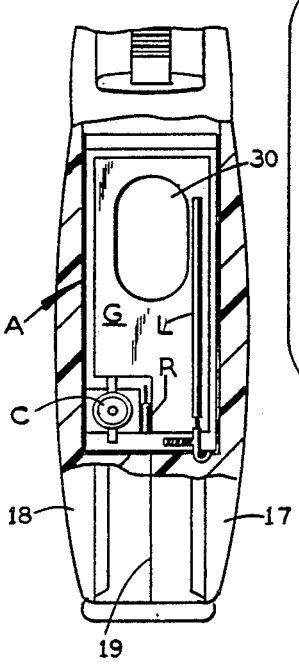
FIG. 6 is a view showing the gun handle partly in rear elevation and partly in section.

The handle 11 also has plastic side pieces 17 and 18 (FIGS. 2 and 6) which engage the outside of its metal inner body 16 on opposite sides and at the back. Side piece 17 covers the opening 116 and side piece 18 covers the opening 116'. At the back the plastic side pieces 17 and 18 engage each other along a line 19, as shown in FIGS. 6 asnd 11. Together the side pieces 17 and 18 constitute a grip on the outside of the handle.

In accordance with this invention, the metal inner body 16 of the handle is unchanged, the plastic side pieces 17 and 18 which form the handle grip are unchanged on the outside and are modified only by providing shallow recesses on the inside, and the magazine casing M is unchanged on the outside and is modified only on the inside.

Figure 5:
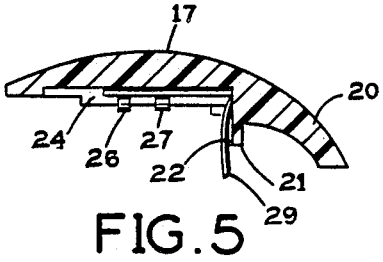
FIG. 5 is a cross-section taken along the line 5—5 in FIG. 4.
Figure 4:
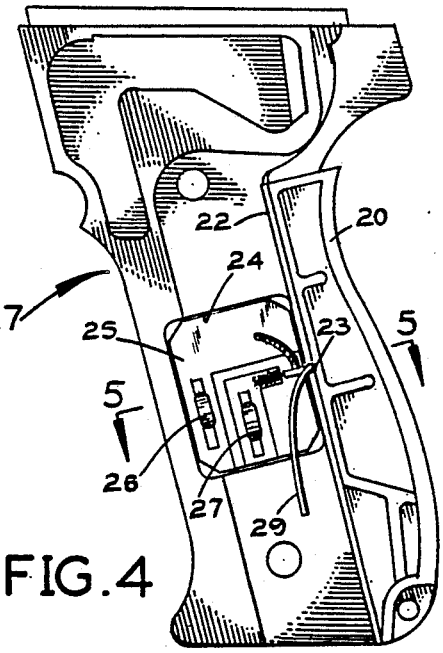
FIG. 4 is a similar view of the right side piece of this grip, taken along the line 4—4 in FIG. 2.
Figure 7:
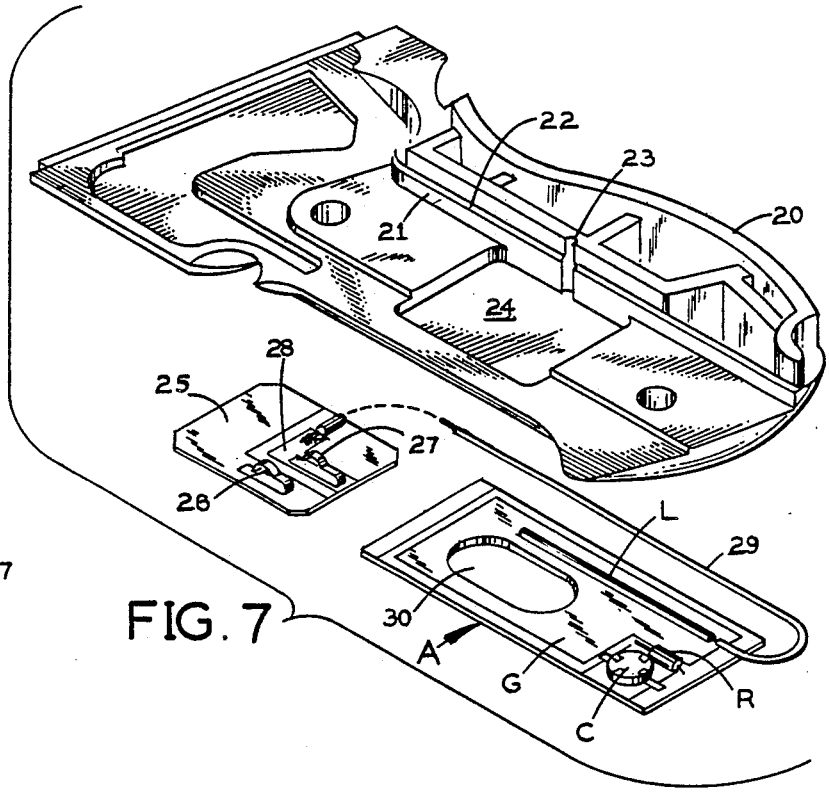
FIG. 7 is an exploded perspective view showing the inside of the right side piece of the grip, the antenna assembly and the spring contacts for the antenna.
Figure 8:
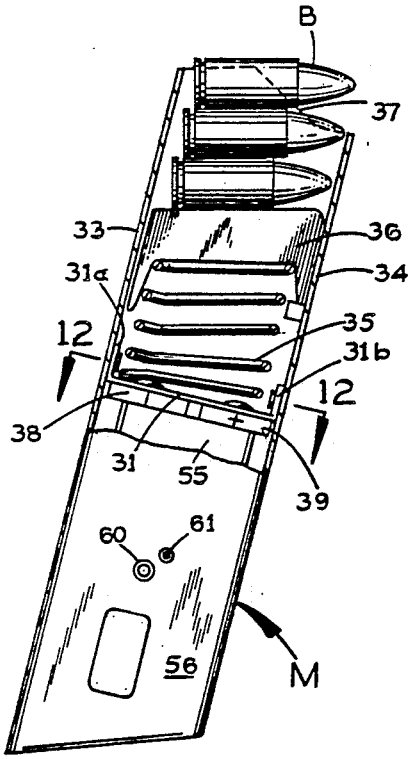
FIG. 8 is a view of the magazine casing for reception in the gun handle, showing its lower half in right side elevation and its upper half in section.
Figure 9:
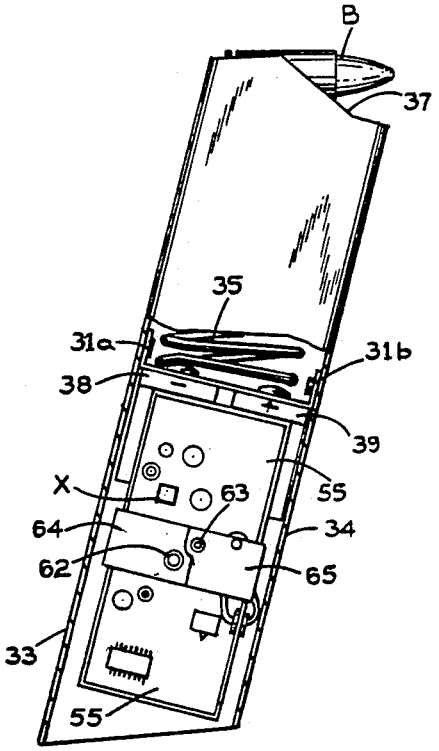
FIG. 9 is a view of the magazine casing showing its lower half in section and its upper half in side elevation.
Figure 10:
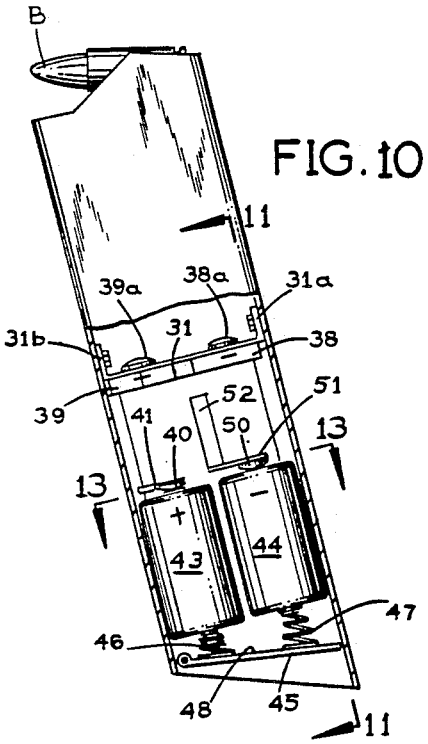
FIG. 10 is a view generally like FIG. 9 but taken from the left side of the magazine casing.

FIG. 5 shows the grip side piece 17 in cross-section. FIG. 4 shows it in elevation, viewed from its inner side (i.e., the side next to the metal inner body 16 of the handle). FIG. 7 shows it in perspective, viewed from its inner side. Side piece 17 has a curved outer back wall 20 (FIG. 5) and a flat inside back wall 21 spaced in front of the outer back wall 20. As best seen in FIG. 7, the inside back wall 21 presents a narrow, flat, inwardly facing, transverse shoulder 22 along its length from top to bottom above and below a groove 23 of semicircular cross-section. Behind this shoulder the inside back wall 21 of side piece 17 presents a shallow rectangular recess for receiving the right half of a thin, flat antenna circuit board A (FIG. 7) carrying an insulated radiating element L, a tuning capacitor C and a resistor R on its back side, most of which is covered by an electrically conductive layer G, which is the antenna's ground plane.

Figure 3:
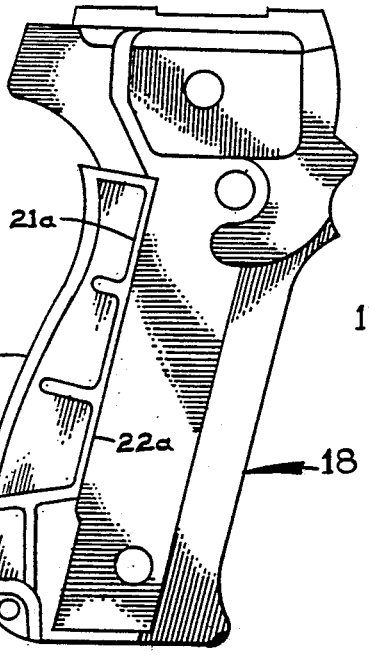
FIG. 3 is a vertical section taken along the line 3—3 and showing in elevation the inner side of the left side piece of the plastic grip on the handle of this gun.

The opposite side piece 18 of the grip (FIG. 3) has a similar curved back wall 20*a* and a flat inside wall 21*a* which presents a shallow recess 22*a* that receives the half of the antenna circuit board A where the tuning capacitor C and resistor R are located. Recess 22*a* in the left side piece 18 of the plastic grip is an extension of the recess behind shoulder 22 in the right side piece 17 of the grip, so together they provide a continuous shallow recess on the inside of the back segment of the two-piece plastic grip 17, 18 on the gun handle.

In front of its inside back wall 21, the grip side piece 17 presents a shallow, generally rectangular recess 24 (FIGS. 5 and 7) which receives a thin flat insulation panel 25 (FIGS. 4 and 8) carrying a pair of spring contacts 26 and 27, each of which has a laterally inwardly protruding rounded segment for engagement by a corresponding switch contact on the outside of the magazine casing M as explained hereinafter. Panel 25 is positioned at a right angle to the antenna circuit board. Spring contact 27 is on a metal foil layer 28 to which one end of an insulated electrical wire 29 is soldered. The opposite end of wire 29 is connected conductively to the radiating element L of the antenna assembly so that spring contact 27 is connected conductively to the antenna radiating element L. As shown in FIG. 4, wire 29 passes through the groove 23 in the inside wall 21 of grip side piece 17.

Figure 15:
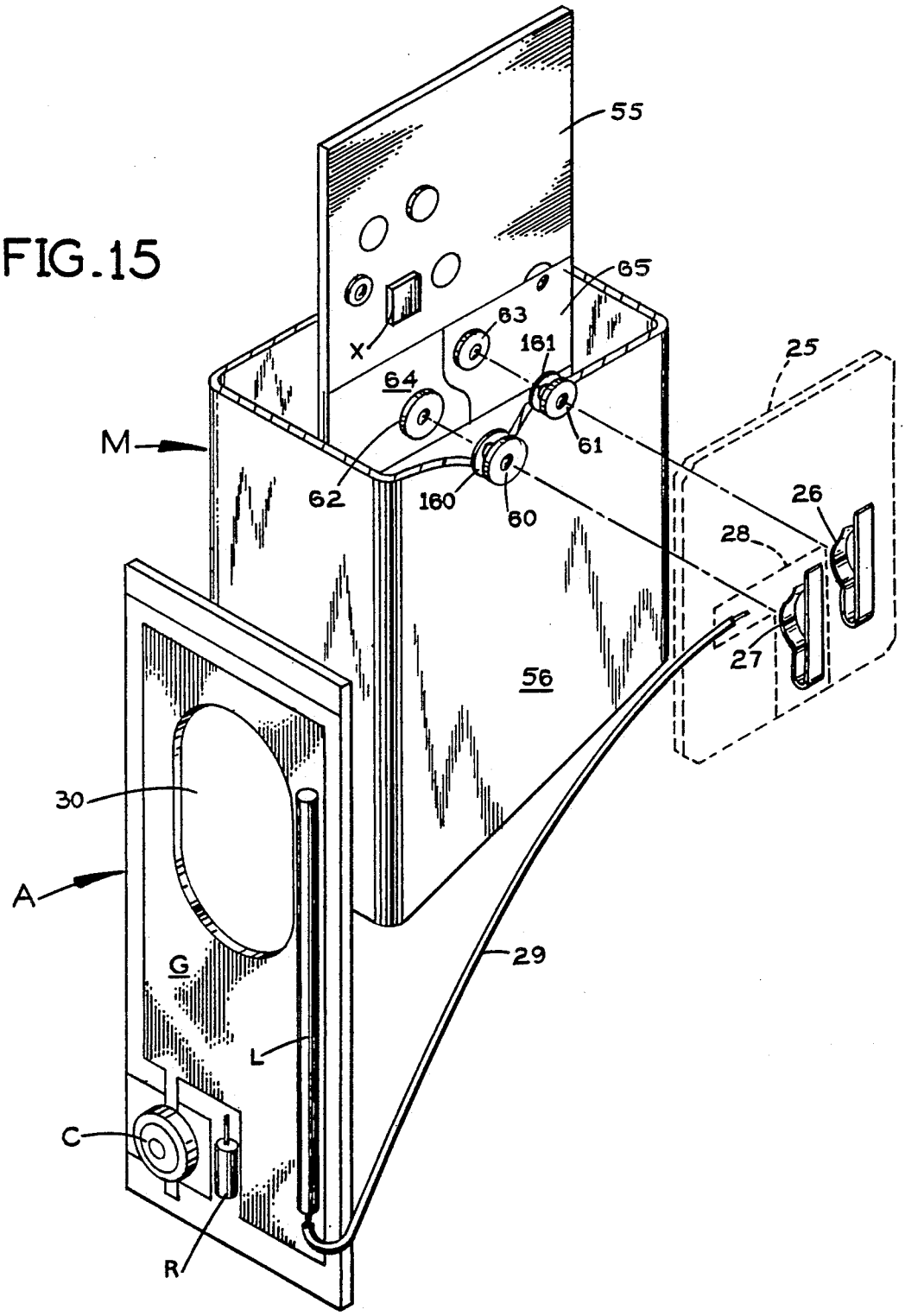
FIG. 15 is an exploded perspective view showing the antenna assembly, the transmitter circuit board, part of the magazine casing, and the electrical contacts for the antenna and the transmitter.

As shown in FIGS. 6, 7 and 15, the antenna circuit board A has an oval opening 30 to provide a clearance for the hammer spring (not shown) that is a standard part of this SigSauer pistol.

In the standard SigSauer pistol its magazine has a bottom wall at its lower end and a coil spring engaged between this bottom wall and a follower that is slidable along the inside of the magazine to push bullets upward to and through a top opening in the magazine.

In accordance with the present invention, the magazine casing M has a false bottom 31 (FIGS. 8, 9 and 10) about half-way up along the inside. This false bottom has upwardly projecting flanges 31*a* and 31*b* on its opposite ends which are attached by screws 32 (FIG. 12) to the contiguous rear and front walls 33 and 34 of the magazine casing M. An oblong coil spring 35 is engaged under compression between the false bottom 31 and a follower 36 (FIG. 8) slidably received in the magazine casing and engaging a stack of bullets B from below. The magazine casing has an opening 37 at the top and front for passing the uppermost bullet B.

A pair of cylindrical insulation blocks 38 and 39 (FIGS. 10, 11 and 14) are attached to the false bottom 31 by respective screws 38*a* and 39*a* and extend down from it inside the magazine casing M. A printed circuit board 55 which carries a microphone and all the components of a radio transmitter is snugly but slidably received inside the magazine between these insulation blocks and the right side 56 of the magazine casing M.

A screw 40 (FIG. 11) of electrically conductive metal clamps an eyelet 41 of similar material against the bottom of block 38. An insulated electrical wire 42 extends from eyelet 41 to a positive terminal in the transmitter circuit on board 55.

An identical screw 50 (FIGS. 10 and 13) clamps a metal eyelet 51 against the bottom of block 39. Eyelet 51 is joined to one end of a conductive strap 52 which is soldered to a conductive layer on the inner face of the transmitter circuit board 55 to provide a ground connection for screw 50.

Screws 40 and 50 present downwardly-facing convex heads that serve as electrical contacts for engagement by the terminals of a pair of batteries 43 and 44. The positive terminal of battery 43 engages contact 40 and the negative terminal of battery 44 engages contact 50. Each of these batteries is a ⅔ AA size lithium battery of known design.

Below the batteries, a bottom wall 45 inside the magazine casing M supports a pair of coil springs 46 and 47, which are engaged under compression between this wall and the lower ends of batteries 43 and 44, respectively. The positive terminal of battery 44 is on its lower end and is engaged by the upper end of spring 47. The negative terminal of battery 43 is on its lower end and is engaged by the upper end of spring 46. Springs 46 and 47 hold the batteries up against the battery switch contacts 40 and 50.

The transmitter printed circuit board 55 (FIGS. 11 and 12) is engaged snugly between the insulation blocks 38 and 39 and the right side 56 of magazine casing M. This board carries a microphone X (FIGS. 9 and 15) and the components of a radio transmitter, which preferably is a crystal-controlled transmitter operating at a selected frequency within one of several VHF high band frequency ranges, including the 140–174 megaHertz range. The transmitter components and the microphone are in a shallow recess 57 (FIG. 11) in the side of the printed circuit board toward the right side 56 of the magazine casing.

Figure 14:
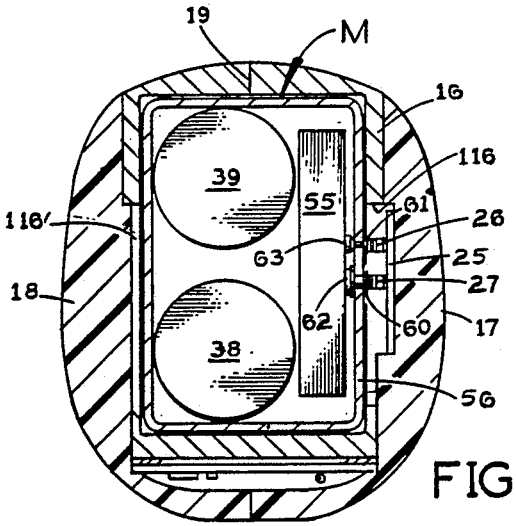
FIG. 14 is a cross-section taken along the line 14—14 in FIG. 11.

First and second electrical contacts 60 and 61 (FIGS. 8 and 15) project outward slightly from the right side 56 of the magazine casing M. Contact 61 is grounded to the magazine and contact 60 is electrically insulated from it. Contact 60 on the outside of magazine casing M is positioned to engage the spring contact 27 (FIGS. 4 and 15) on the inside of the right side piece 17 of the gun handle grip when the magazine casing M is fully inserted into the metal inner body 16 of the gun handle. Similarly, contact 61 on the outside of magazine M is positioned to engage the other spring contact 26 on the inside of the right side piece 17 of the grip when the magazine is fully inserted. As shown in FIG. 14, metal inner body 16 of the gun handle has an opening 116 in this side through which the spring contacts 26 and 27 project for engagement by contacts 61 and 60 on the outside of the magazine.

As best seen in FIG. 15, the contacts 60 and 61 on the outside of the magazine casing are connected to corresponding contacts 160 and 161 located on the inside of magazine casing's right side wall 56. Contact 161 is grounded to the magazine casing and contact 160 is insulated from it. Contacts 160 and 161 on the inside of the magazine casing are positioned to be engaged by corresponding contacts 62 and 63 on corresponding conductive inserts 64 and 65 on the outer side of the transmitter circuit board 55 when board 55 is inserted fully into magazine casing M. Contact 62 is connected by a conductor (not shown) to an appropriate part of the transmitter circuit and contact 63 provides a ground connection for the transmitter circuit.

In the assembly of this invention, with the magazine casing M and the pieces 17 and 18 of the handle grip removed from the metal inner body 16 of the gun handle, the panel 25 which carries spring contacts 26 and 27 is positioned in recess 24 in the right side piece 17 of the gun grip and anchored in it by a suitable potting compound, and the antenna assembly A is similarly positioned in the back recess on the inside of the grip with its radiating element L on the back side.

The plastic grip 17 and 18 is affixed to the back and the opposite sides of the metal inner body 16 of the gun handle so that the antenna assembly A is behind body 16 and the spring contacts 26 and 27 are exposed at the opening 116 in the right side of the handle body 16.

The printed circuit board 55 for the transmitter is engaged between the insulation blocks 38 and 39 and the right side 56 of magazine casing M and batteries 43 and 44 are positioned below these insulation blocks next to the lower part of transmitter circuit board 55, making contact with the screw heads 40 and 50 to connect the batteries electrically to the transmitter on PC board 55.

When the magazine casing M is slid up into the metal inner body 16 of the gun handle, the switch contacts 61 and 60 on the outside of its right side wall 56 engage the spring contacts 26 and 27 respectively to connect the elements of antenna assembly A to the transmitter on PC board 55 and to batteries 43 and 44. Therefore, the radio transmitter is made fully operational simply by sliding magazine casing M into the metal inner body 16 of the gun handle. From the outside, the gun handle looks the same as the usual gun handle on this SigSauer pistol and bullets may be fired from the pistol in the usual way. Therefore, there is nothing in the pistol's appearance to warrant suspicion or uneasiness on the part of a person under surveillance.

We claim:

1. A SigSauer pistol having:

a hollow metal handle body of generally rectangular cross-section with a front wall, a back wall, and opposite side walls with respective openings therein, said handle body having a longitudinal cavity between said front, opposite side and back walls which is open at the lower end of said handle body for the slidable insertion and removal of a magazine casing for holding bullets;

a plastic grip having a back segment on the outside of said back wall of said metal handle body and side segments on the outside of said side walls of said metal handle body covering said openings in said side walls;

said back segment of said grip having a shallow recess which is open at the front of said back segment;

an antenna assembly received in said recess, said antenna assembly including a radiating element;

one of said side segments of said grip having a shallow recess which is open at the inside of said one side segment and registers with said opening in the corresponding side wall of said metal handle body;

an insulation panel received in said recess in said one side segment of said grip, first and second spring contacts on said insulation member, said contacts being exposed at the inside of said one side segment of said grip and projecting through said opening in the corresponding side wall of said metal handle body, said first contact being conductively connected to said radiating element of said antenna assembly, and insulated electrical wires connected conductively to said first contact and extending outside said recess in said one side segment of the grip;

a hollow magazine casing slidably insertable into and removable from said longitudinal cavity in said metal handle body through said open lower end, said magazine casing having a front wall, opposite side walls and a back wall, a pair of electrical contacts on the outside of one of said side walls of the magazine casing for engagement respectively with said spring contacts when said magazine casing is fully inserted into said longitudinal cavity in said metal handle body;

a false bottom in said magazine casing spaced above the lower end of the magazine casing, a spring-operated follower slidably received in said magazine casing above said false bottom for pushing bullets up along the magazine casing;

said magazine casing having a chamber below said false bottom, battery switch contacts in said chamber for engagement by battery terminals, and a radio transmitter and microphone in said chamber having electrical connections to said battery switch contacts and said electrical contacts on the outside of said magazine casing.

2. A pistol according to claim 1 wherein said antenna assembly comprises:

a thin flat circuit board received in said shallow recess in said back segment of said grip;

a ground plane on the rear face of said circuit board;

and a radiating element on said rear face of said circuit board.

3. A pistol according to claim 2 wherein:

said transmitter and microphone are on a printed circuit board positioned in said chamber next to said one side wall of said magazine casing;

and said battery switch contacts face downward in said chamber between said printed circuit board and the opposite side wall of the magazine casing from said one side wall for engagement with respective batteries received in said chamber between said printed circuit board and said opposite side wall of the magazine casing.

4. A pistol according to claim 3 and further comprising:

a pair of electrical contacts on the inside of said one side wall of the magazine casing which are respectively connected conductively to said contacts on the outside of said one side wall of the magazine casing;

and a pair of electrical contacts on said printed circuit board connected electrically to said transmitter and microphone and engaging said contacts on the inside of said one side wall of the magazine casing.

5. A pistol according to claim 1 wherein:

said transmitter and microphone are on a printed circuit board in said chamber next to said one side wall of the magazine casing;

and further comprising:

a pair of electrical contacts on the inside of said one side wall of the magazine casing which are respectively connected conductively to said contacts on the outside of said one side wall of the magazine casing;

and a pair of electrical contacts on said printed circuit board connected electrically to said transmitter and microphone and engaging said contacts on the inside of said one side wall of the magazine casing.

6. A pistol according to claim 5 wherein:

said battery switch contacts face downward in said chamber between said printed circuit board and the opposite side wall of the magazine casing from said one side wall.

7. A pistol according to claim 6 wherein said antenna assembly comprises:

a thin flat circuit board received in said shallow recess in said back segment of said grip;

a ground plane on the rear face of said circuit board;

and a radiating element on said rear face of said circuit board.

8. A pistol comprising:

a hollow metal handle body having a front wall, a back wall and opposite side walls, one of said side walls having an opening therein, said metal handle body having a longitudinal cavity therein between said front, back and side walls which is open at the lower end of said metal handle body for the slidable insertion and removal of a magazine casing for holding bullets;

a plastic grip on the outside of said back and side walls of said metal handle body, said grip having a shallow first recess therein which is open next to said back wall of said metal handle body and a shallow second recess therein which is open next to said opening in said one side wall of said metal handle body;

an antenna circuit board received in said first recess and carrying a radiating element and a ground plane;

an insulation panel received in said second recess, first and second electrical contacts on said panel which are exposed at said opening in said one side wall of said metal handle body, one of said contacts being connected to said radiating element and the other of said contacts being grounded;

a hollow magazine casing slidably received in said longitudinal cavity in said metal handle body;

a false bottom in said magazine casing spaced above the lower end of the magazine casing, a spring-operated follower slidably received in said magazine casing above said false bottom for pushing bullets up along the magazine casing;

a pair of electrical contacts on the outside of said magazine casing for engagement with said first and second contacts on said insulation panel when said magazine casing is fully inserted into said longitudinal cavity in said metal handle body;

said magazine casing having a chamber below said false bottom;

battery switch contact means in said chamber for engagement by respective battery terminals;

and a radio transmitter and a microphone in said chamber connected electrically to said contacts on the outside of said magazine casing and to said battery switch contact means.

9. A pistol according to claim 8 wherein:

said electrical contacts on the outside of the magazine casing are on one wall thereof;

and further comprising:

a pair of electrical contacts on the inside of one wall of the magazine casing respectively connected conductively to said contacts on the outside of said one wall of the magazine casing;

a printed circuit board carrying said transmitter and microphone and positioned in said chamber next to said one wall of the magazine casing;

and a pair of electrical contacts on said printed circuit board engaging said contacts on the inside of said one wall of the magazine casing and connected electrically to said transmitter.

10. A pistol according to claim 9 wherein:

said battery switch contact means faces downward in said chamber on the opposite side of said printed circuit board from said one wall of the magazine casing.

* * * * *